US008646398B1

(12) United States Patent
Ansel, Jr.

(10) Patent No.: US 8,646,398 B1
(45) Date of Patent: Feb. 11, 2014

(54) ADJUSTABLE BOAT MOORING STANDOFF

(71) Applicant: Irvine Legare Ansel, Jr., Anderson, SC (US)

(72) Inventor: Irvine Legare Ansel, Jr., Anderson, SC (US)

( * ) Notice: Subject to any disclaimer, the term of this patent is extended or adjusted under 35 U.S.C. 154(b) by 0 days.

(21) Appl. No.: 13/747,852

(22) Filed: Jan. 23, 2013

Related U.S. Application Data

(63) Continuation-in-part of application No. 13/672,729, filed on Nov. 9, 2012, now Pat. No. 8,601,968.

(51) Int. Cl.
*B63B 21/00* (2006.01)

(52) U.S. Cl.
USPC ..... 114/230.15; 114/230.27

(58) Field of Classification Search
USPC ..... 114/221 R, 230.2, 230.15, 230.26, 114/230.27
See application file for complete search history.

(56) References Cited

U.S. PATENT DOCUMENTS

| | | | | | |
|---|---|---|---|---|---|
| 2,924,291 | A * | 2/1960 | Tunstead | 182/156 |
| 3,151,595 | A * | 10/1964 | Stainbrook | 114/230.25 |
| 3,406,651 | A * | 10/1968 | Jalbert | 114/230.17 |
| 5,493,991 | A * | 2/1996 | Wright et al. | 114/230.27 |
| 5,634,421 | A * | 6/1997 | Velarde | 114/230.15 |
| 6,123,045 | A * | 9/2000 | Prongay | 114/230.15 |
| 6,928,945 | B1 * | 8/2005 | Tebo, Jr. | 114/230.15 |
| 7,789,033 | B2 * | 9/2010 | Doig et al. | 114/230.17 |
| 8,091,499 | B1 * | 1/2012 | Perez | 114/230.15 |
| 2009/0025188 | A1 * | 1/2009 | Leyden et al. | 24/115 H |

* cited by examiner

*Primary Examiner* — Stephen Avila

(57) ABSTRACT

This invention is mounted to a boat and consists of a tee, a pipe, a mooring rope, and a mooring buoy or a pipe, a mooring rope, and a mooring buoy. A mooring rope connected to the tee or to the dock extends through the interior channel of the standoff to a boat mooring cleat located on the side of the boat furthest from the dock. A mooring buoy secures the device to the boat. A rope, chain or cable mounted vertically to the dock and passed vertically through the tee allows the boat to move freely to compensate for movement caused by large waves or tidal changes while holding the boat away from the dock or a mooring rope attached to the dock allows the boat to move freely to compensate for movement caused by large waves while holding the boat away from the dock.

2 Claims, 23 Drawing Sheets

ADJUSTABLE BOAT MOORING STANDOFF

BACKGROUND OF THE INVENTION

This invention pertains to a mooring device and more particularly to an adjustable boat mooring device used to secure a boat to a dock, pier, or piling.

There are many devices in use for mooring a boat to a dock to prevent the boat from striking the dock. Generally, these devices are mounted to the dock or mounted between the dock and the boat.

U.S. Pat. No. 6,928,945 to Tebo, Jr. discloses a boat mooring standoff with the first end permanently mounted to the dock and the second end attached with a rope to a dockside mooring cleat on the boat.

U.S. Pat. No. 5,634,421 to Velarde discloses a boat mooring standoff used to attach a boat to a dock or a boat to another boat. The boat mooring standoff is secured by a flexible line that extends through the interior channel of the device. The first end of the flexible line is attached to the dockside mooring cleat on the boat and the second end of the flexible line is attached to the dock.

These devices are designed to utilize the dock to hold the boat in a fixed position away from the dock. These devices have very little flexibility and do not compensate for movement of the boat caused by large waves or tidal changes.

U.S. Pat. No. 7,789,033 to Doig, et al. discloses a boat mooring system with an arm assembly mounted to the dock and extending at a desired angle over the side of the boat. A mooring line is connected from the arm assembly to a dockside mooring cleat on the boat.

This device provides more flexibility to compensate for movement of the boat caused by large waves, but it is mounted on the dock and utilizes the dock to hold the boat in a fixed position away from the dock.

Limitations of prior art which utilize the dock to mount or attach a boat mooring standoff make it desirable to mount a boat mooring standoff on a boat to compensate for movement of the boat caused by large waves or tidal changes and to become a part of the boat instead of a part of the dock or an arm between the dock and the boat. It is also desirable to attach a boat mooring standoff to a boat using the boat mooring cleat on the side of the boat located furthest from the dock instead of attaching the boat mooring standoff to the boat mooring cleat on the side of the boat closest to the dock to provide more flexibility to the boat mooring standoff in order to compensate for movement of the boat caused by large waves and to insure the boat mooring standoff is firmly attached to the boat. In order to compensate for the difference in the distance between the dock, pier, or piling and the stern boat mooring cleat compared to the distance between the dock, pier, or piling and the bow boat mooring cleat, it is desirable to have a boat mooring standoff that is adjustable.

BRIEF SUMMARY OF THE INVENTION

This invention is an adjustable boat mooring standoff mounted on a boat instead of a dock which offers greater flexibility to the standoff because the standoff becomes a part of the boat instead of a part of the dock and moves with the boat as the boat is pushed toward the dock by large waves. A straight tee connected to the first end of the adjustable boat mooring standoff permits the standoff to be attached to a rope, chain or cable mounted vertically to a dock, pier or piling. Because the two in line outlets of the straight tee are installed in a vertical position, this enables the boat mooring standoff to compensate for movement of the boat caused by large waves or tidal changes. For users who desire to attach the adjustable boat mooring standoff directly to the dock, pier, or piling, two holes on the first end of the adjustable boat mooring standoff replace the straight tee.

The adjustable boat mooring standoff consists of one straight tee, one straight pipe, a dock mooring rope, and a mooring buoy, bumper, or fender or one straight pipe, a dock mooring rope, and a mooring buoy, bumper, or fender. The looped first end of the dock mooring rope is connected to the straight tee or attached to the dock, pier, or piling and the second end is extended through the interior channel of the adjustable boat mooring standoff and through the eye of a mooring buoy, bumper, or fender to a boat mooring cleat located on the side of the boat furthest from the dock, pier, or piling. The dock mooring rope pulls the mooring buoy, bumper, or fender against the exterior side of the boat closest to the dock, pier, or piling to insure the adjustable boat mooring standoff is firmly attached to the boat.

DETAILED DESCRIPTION OF THE INVENTION

Figure 1:
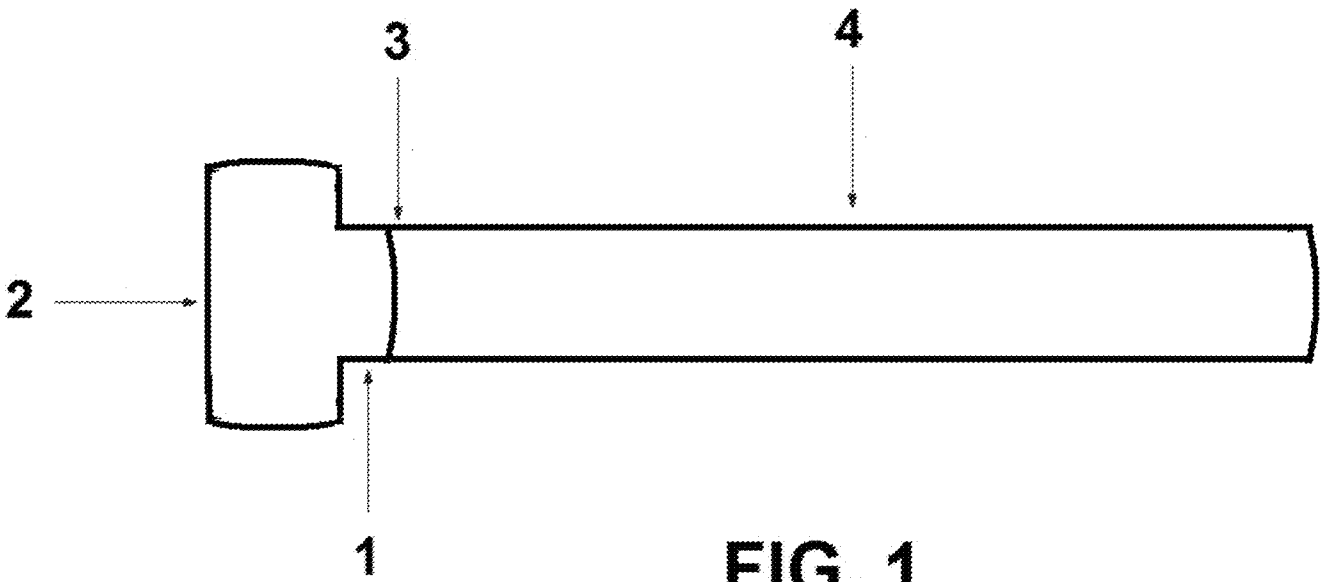
FIG. 1 is an elevation view of the adjustable boat mooring standoff during assembly depicting the main branch outlet of the straight tee connected to the first end of the straight pipe.

There are two methods to assemble the adjustable boat mooring standoff. The first method is to install a straight tee to the first end of the straight pipe to secure the boat mooring standoff to the dock, pier, or piling. The second method is to drill two attachment holes near the first end of the straight pipe to secure the boat mooring standoff to the dock, pier, or piling. The choice to use the straight tee or the two attachment holes depends on whether or not there is a need to compensate for tidal changes. Both methods will secure the adjustable boat mooring standoff to the dock, pier, or piling.

This invention may be constructed using PVC, molded composites, or metal. The following is a detailed description of how to assemble the adjustable boat mooring standoff using the straight tee:

The first step is to connect the first end of the straight pipe to the main branch outlet of the straight tee which is perpendicular to the first and second in line outlets of the tee.

The second step is to place the straight tee and the straight pipe on a flat surface with the first and second in line outlets and the main branch outlet of the straight tee and the straight pipe resting on the flat surface.

The third step is to locate a point on the center line of the straight pipe near the main branch outlet of the straight tee.

The fourth step is to drill an access hole on the center line of the straight pipe near the main branch outlet of the straight tee.

The fifth step is to rotate the straight tee and the straight pipe 90° so that the two in line outlets of the straight tee are perpendicular to the flat surface.

The sixth step is to locate five points with equal spacing along the bottom center line of the straight pipe between the access hole and the second end of the straight pipe.

The seventh step is to drill five buoy support holes along the bottom center line of the straight pipe between the access hole and the second end of the straight pipe. The buoy support holes allow the position of the mooring buoy, bumper, or fender to be adjusted and the number of holes varies depending on the length of the straight pipe.

The eighth step is to place the looped first end of the first dock mooring rope over the main branch outlet of the straight tee.

The ninth step is to guide the second end of the first dock mooring rope around the first and second in line outlets of the straight tee.

The tenth step is to guide the second end of the first dock mooring rope between the looped first end of the first dock mooring rope and the main branch outlet of the straight tee.

The eleventh step is to insert the second end of the first dock mooring rope into the access hole on the center line of the straight pipe near the main branch outlet of the straight tee.

The twelfth step is to guide the second end of the first dock mooring rope through the interior of the straight pipe and out of one of the five buoy support holes located along the bottom center line of the straight pipe and through the eye of the mooring buoy, bumper, or fender. The buoy support hole selected determines the distance between the boat and the dock, pier, or piling. In this example, the second buoy support hole is used.

The thirteenth step is to guide the second end of the first dock mooring rope back through the second buoy support hole located on the bottom center line of the straight pipe and through the interior of the straight pipe and out of the second end of the straight pipe.

The fourteenth step is to tug on the second end of the first dock mooring rope tightly to insure the looped first end of the first dock mooring rope is bound tightly around the main branch outlet of the straight tee.

The following is a detailed description of how to install the adjustable boat mooring standoff with the straight tee to the stern of a boat:

The first step is to place the adjustable boat mooring standoff on the first side of the boat near the first stern mooring cleat with the mooring buoy, bumper, or fender positioned on the exterior of the first side of the boat and pointed down.

The second step is to place the looped first end of the second dock mooring rope over the straight pipe between the mooring buoy, bumper, or fender and the second end of the straight pipe.

The third step is to guide the second end of the second dock mooring rope around the first stern mooring cleat and to secure the second dock mooring rope to the cleat. This restricts the forward and aft movement of the boat when the adjustable boat mooring standoff is in use.

The fourth step is to guide the second end of the first dock mooring rope around the second stern mooring cleat located on the second side of the boat opposite the first stern mooring cleat. Pull the first dock mooring rope tightly and secure it to the cleat. This forces the mooring buoy, bumper, or fender against the exterior of the first side of the boat and secures the adjustable boat mooring standoff firmly to the boat.

The following is a detailed description of how to install the adjustable boat mooring standoff with the straight tee to the bow of a boat:

The first step is to place the adjustable boat mooring standoff on the first side of the boat near the first bow mooring cleat with the mooring buoy, bumper, or fender positioned on the exterior of the first side of the boat and pointed down.

The second step is to guide the second end of the first dock mooring rope around the second bow mooring cleat located on the second side of the boat opposite the first bow mooring cleat. Pull the first dock mooring rope tightly and secure it to the cleat. This forces the mooring buoy, bumper, or fender against the exterior of the first side of the boat and secures the adjustable boat mooring standoff firmly to the boat.

The following is a detailed description of how to assemble the adjustable boat mooring standoff using the two attachment holes:

The first step is to place the straight pipe on a flat surface.

The second step is to locate a point on the bottom center line of the straight pipe near the first end of the straight pipe.

The third step is to drill an attachment hole on the bottom center line of the straight pipe near the first end of the straight pipe.

The fourth step is to locate five points with equal spacing along the bottom center line of the straight pipe between the attachment hole and the second end of the straight pipe.

The fifth step is to drill five buoy support holes along the bottom center line of the straight pipe between the attachment hole and the second end of the straight pipe. The buoy support holes allow the position of the mooring buoy, bumper, or fender to be adjusted and the number of holes varies depending on the length of the straight pipe.

The sixth step is to rotate the straight pipe 180° so that all of the holes are resting on the flat surface.

The seventh step is to locate a point on the top center line of the straight pipe near the first end of the straight pipe and opposite the attachment hole on the bottom center line of the straight pipe.

The eighth step is to drill an attachment hole on the top center line of the straight pipe near the first end of the straight pipe and opposite the attachment hole on the bottom center line of the straight pipe.

The ninth step is to insert the second end of the first dock mooring rope into one of the two attachment holes near the first end of the straight pipe. Use the top attachment hole when attaching the looped first end of the first dock mooring rope to a dock post and use the bottom attachment hole when attaching the looped first end of the first dock mooring rope to a dock cleat.

The tenth step is to guide the second end of the first dock mooring rope through the interior of the straight pipe and out of one of the five buoy support holes located along the bottom center line of the straight pipe and through the eye of the mooring buoy, bumper, or fender. The buoy support hole selected determines the distance between the boat and the dock, pier, or piling. In this example, the second buoy support hole is used.

The eleventh step is to guide the second end of the first dock mooring rope back through the second buoy support hole located on the bottom center line of the straight pipe and through the interior of the straight pipe and out of the second end of the straight pipe.

The following is a detailed description of how to install the adjustable boat mooring standoff with the two attachment holes to the stern of a boat:

The first step is to position the adjustable boat mooring standoff on the first side of the boat near the first stern mooring cleat with the mooring buoy, bumper, or fender positioned on the outside of the boat and pointed down.

The second step is to place the looped first end of the second dock mooring rope over the straight pipe between the mooring buoy, bumper, or fender and the second end of the straight pipe.

The third step is to guide the second end of the second dock mooring rope around the first stern mooring cleat and to secure the second dock mooring rope to the cleat. This restricts the forward and aft movement of the boat when the adjustable boat mooring standoff is in use.

The fourth step is to guide the second end of the first dock mooring rope around the second stern mooring cleat located on the second side of the boat opposite the first stern mooring cleat. Pull the first dock mooring rope tightly and secure it to the cleat. This forces the mooring buoy, bumper, or fender against the exterior of the first side of the boat and secures the adjustable boat mooring standoff firmly to the boat.

The following is a detailed description of how to install the adjustable boat mooring standoff with the two attachment holes to the bow of a boat:

The first step is to place the adjustable boat mooring standoff on the first side of the boat near the first bow mooring cleat with the mooring buoy, bumper, or fender positioned on the exterior of the first side of the boat and pointed down.

The second step is to guide the second end of the first dock mooring rope around the second bow mooring cleat located on the second side of the boat opposite the first bow mooring cleat. Pull the first dock mooring rope tightly and secure it to the cleat. This forces the mooring buoy, bumper, or fender against the exterior of the first side of the boat and secures the adjustable boat mooring standoff firmly to the boat.

Referring now to the drawings, and particularly to FIG. 1, the main branch outlet 1 of the straight tee 2 is connected to the first end 3 of the straight pipe 4.

Figure 2:
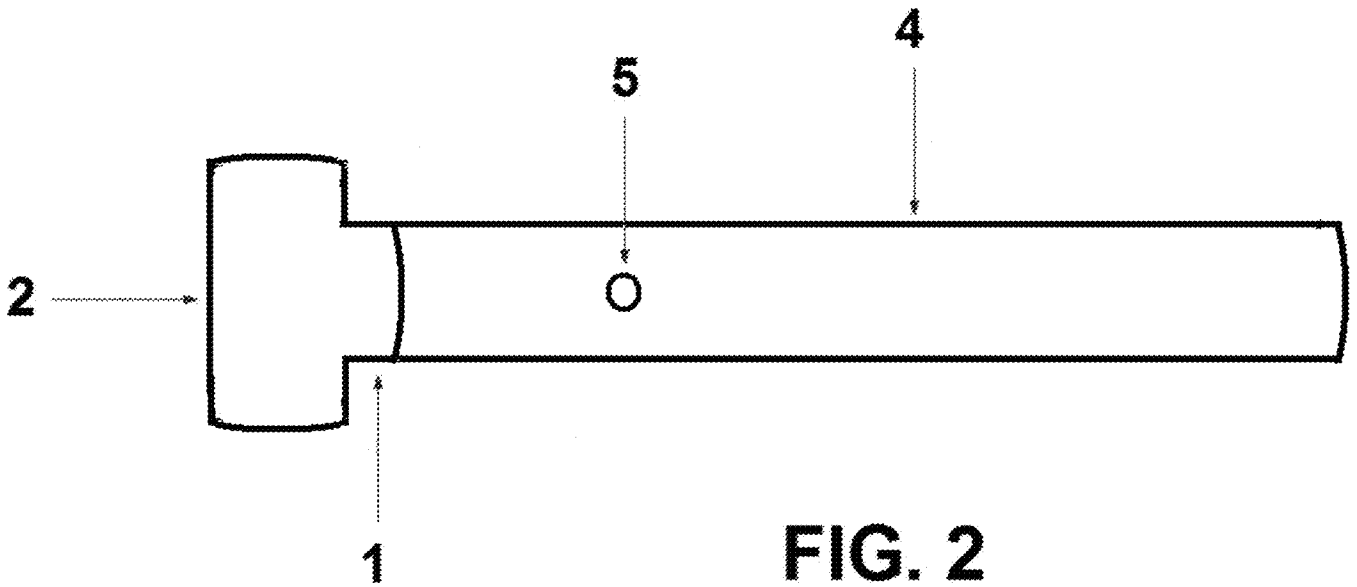
FIG. 2 is an elevation view of the adjustable boat mooring standoff during assembly depicting an access hole drilled on the center line of the straight pipe near the main branch outlet of the straight tee.

Referring to FIG. 2, an access hole 5 is drilled on the center line of the straight pipe 4 near the main branch outlet 1 of the straight tee 2.

Figure 3:
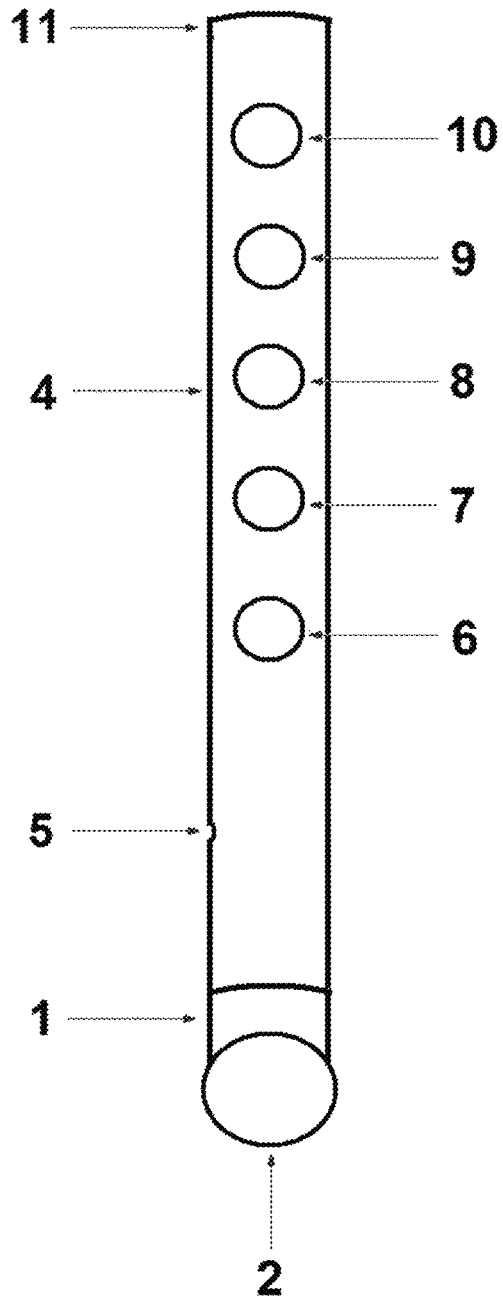
FIG. 3 is a plan view of the adjustable boat mooring standoff during assembly depicting five buoy support holes drilled on the bottom center line of the straight pipe between the access hole near the main branch outlet of the straight tee and the second end of the straight pipe.

Referring to FIG. 3, five buoy support holes, 6, 7, 8, 9, and 10, are drilled on the bottom center line of the straight pipe 4 between the access hole 5 near the main branch outlet 1 of the straight tee 2 and the second end 11 of the straight pipe 4.

Figure 4:
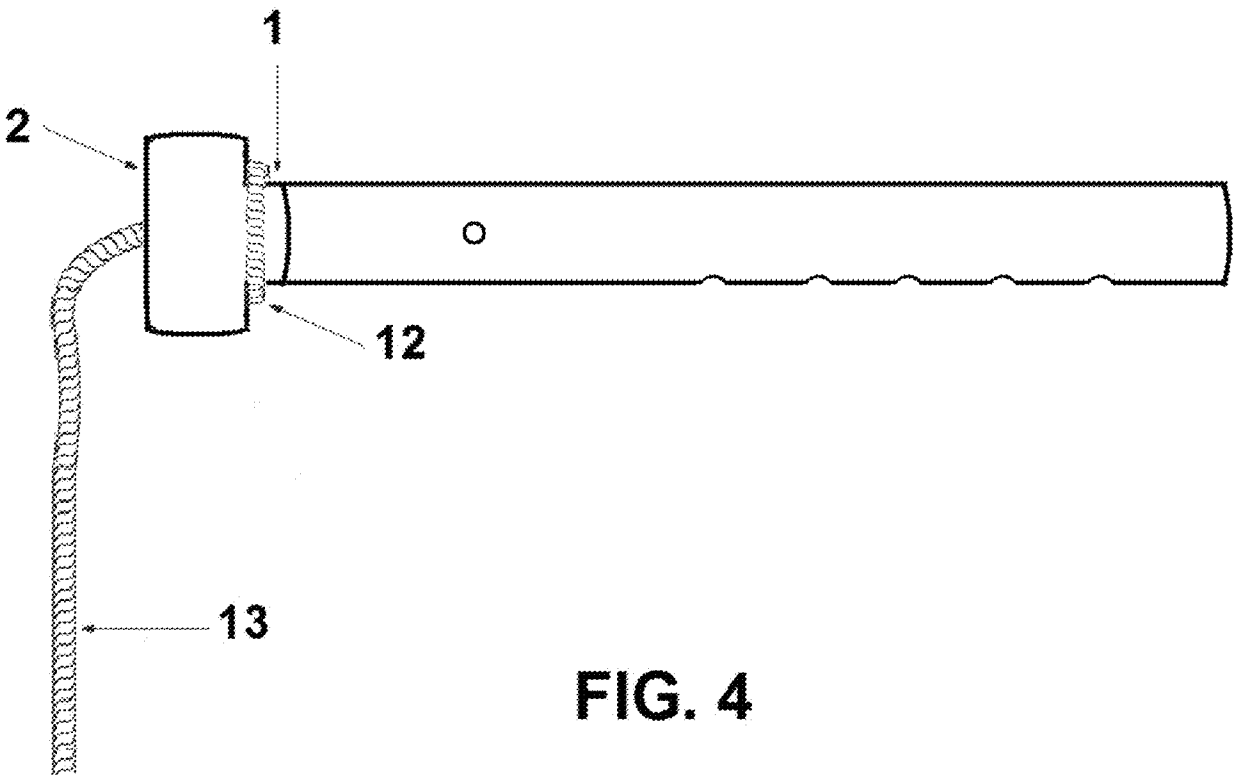
FIG. 4 is an elevation view of the adjustable boat mooring standoff during assembly depicting the looped first end of the first dock mooring rope placed over the main branch outlet of the straight tee.

Referring to FIG. 4, the looped first end 12 of the first dock mooring rope 13 is placed around the main branch outlet 1 of the straight tee 2.

Figure 5:
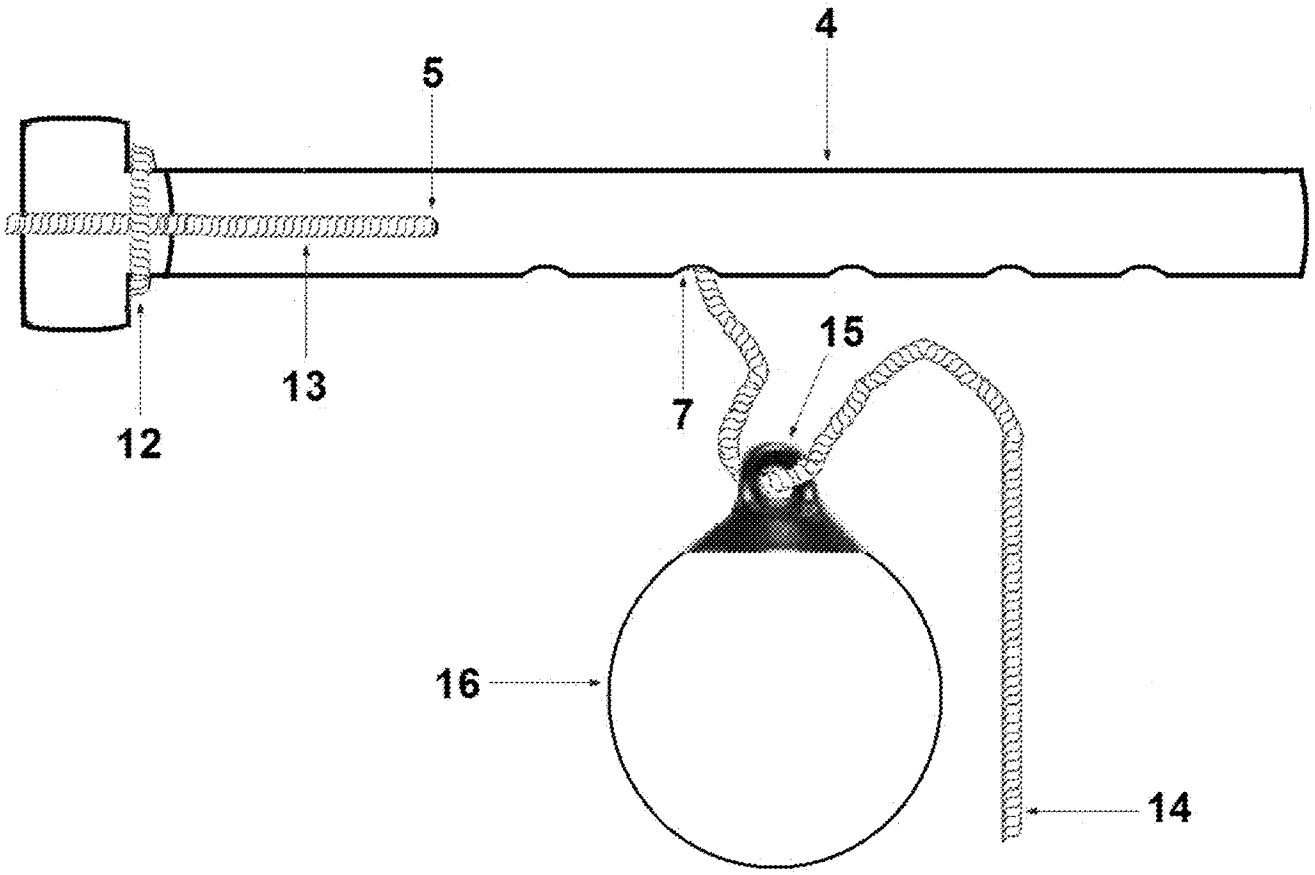
FIG. 5 is an elevation view of the adjustable boat mooring standoff during assembly depicting the second end of the first dock mooring rope routed under the looped first end of the first dock mooring rope and through the access hole on the center line of the straight pipe and through the interior of the straight pipe and out of the second buoy support hole on the bottom center line of the straight pipe and through the eye of the mooring buoy.

Referring to FIG. 5, the second end 14 of the first dock mooring rope 13 is routed under the looped first end 12 of the first dock mooring rope 13 and through the access hole 5 on the center line of the straight pipe 4. The second end 14 of the first dock mooring rope 13 extends through the interior of the straight pipe 4 and out of the second buoy support hole 7 on the bottom center line of the straight pipe 4 and through the eye 15 of the mooring buoy 16.

Figure 6:
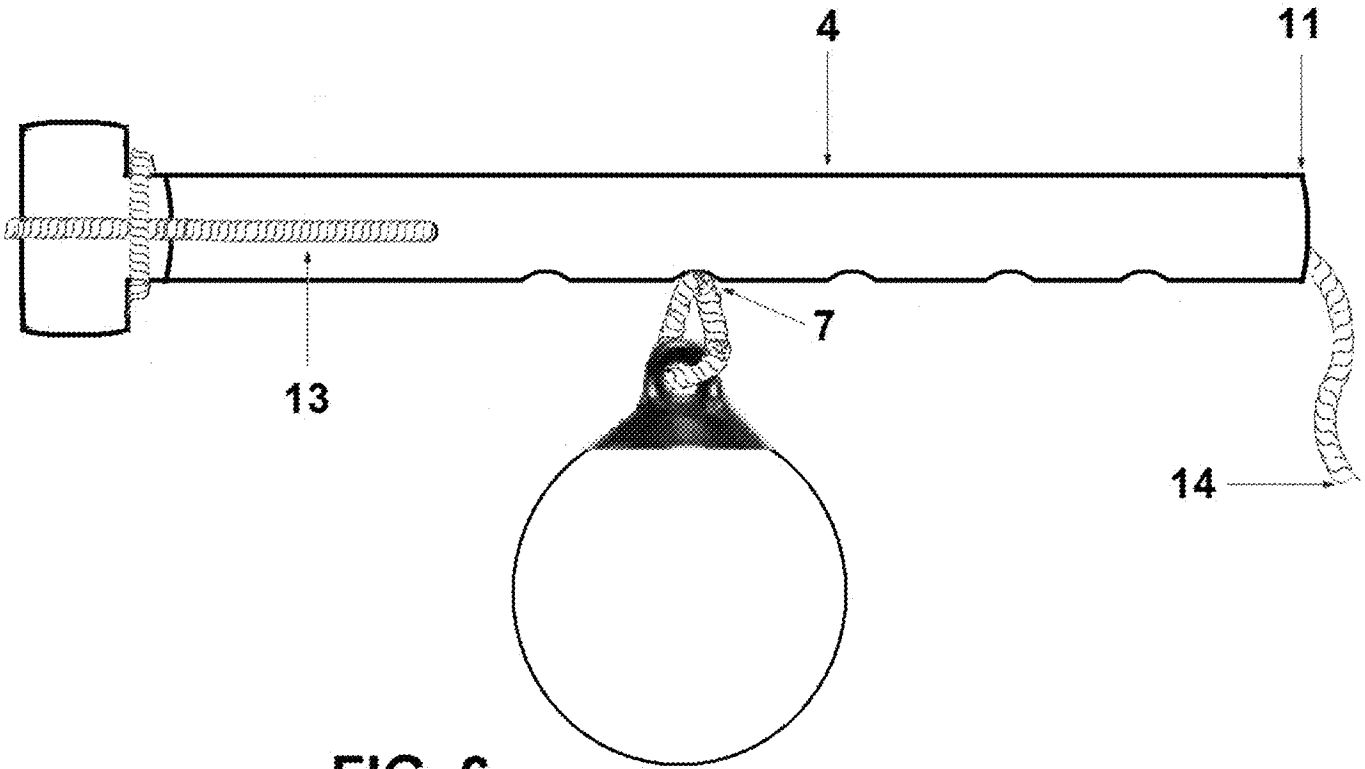
FIG. 6 is an elevation view of the adjustable boat mooring standoff during assembly depicting the second end of the first dock mooring rope routed back through the second buoy support hole on the bottom center line of the straight pipe and through the interior of the straight pipe and out of the second end of the straight pipe.

Referring to FIG. 6, the second end 14 of the first dock mooring rope 13 extends back through the second buoy support hole 7 on the bottom center line of the straight pipe 4 and through the interior of the straight pipe 4 and out of the second end 11 of the straight pipe 4.

Figure 7:
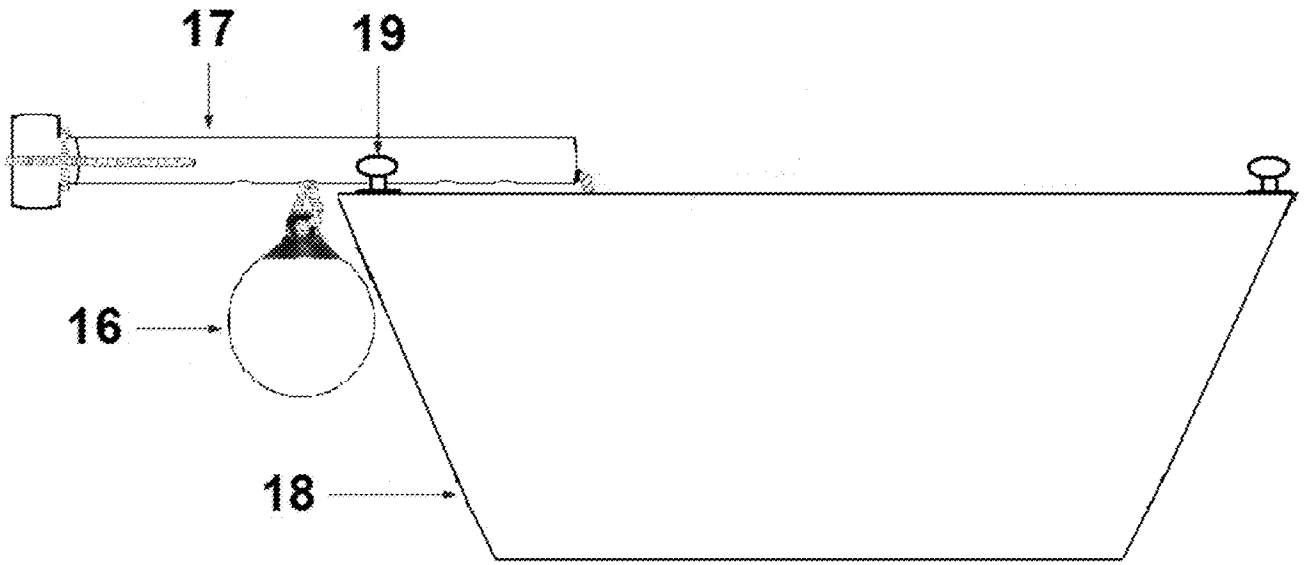
FIG. 7 is an elevation view of the adjustable boat mooring standoff during installation depicting the adjustable boat mooring standoff placed on the first side of the boat near the first stern mooring cleat with the mooring buoy positioned on the exterior of the first side of the boat and pointed down.

Referring to FIG. 7, the adjustable boat mooring standoff 17 is positioned on the first side 18 near the first stern mooring cleat 19 with the mooring buoy 16 on the exterior of the first side 18 and pointed down.

Figure 8:
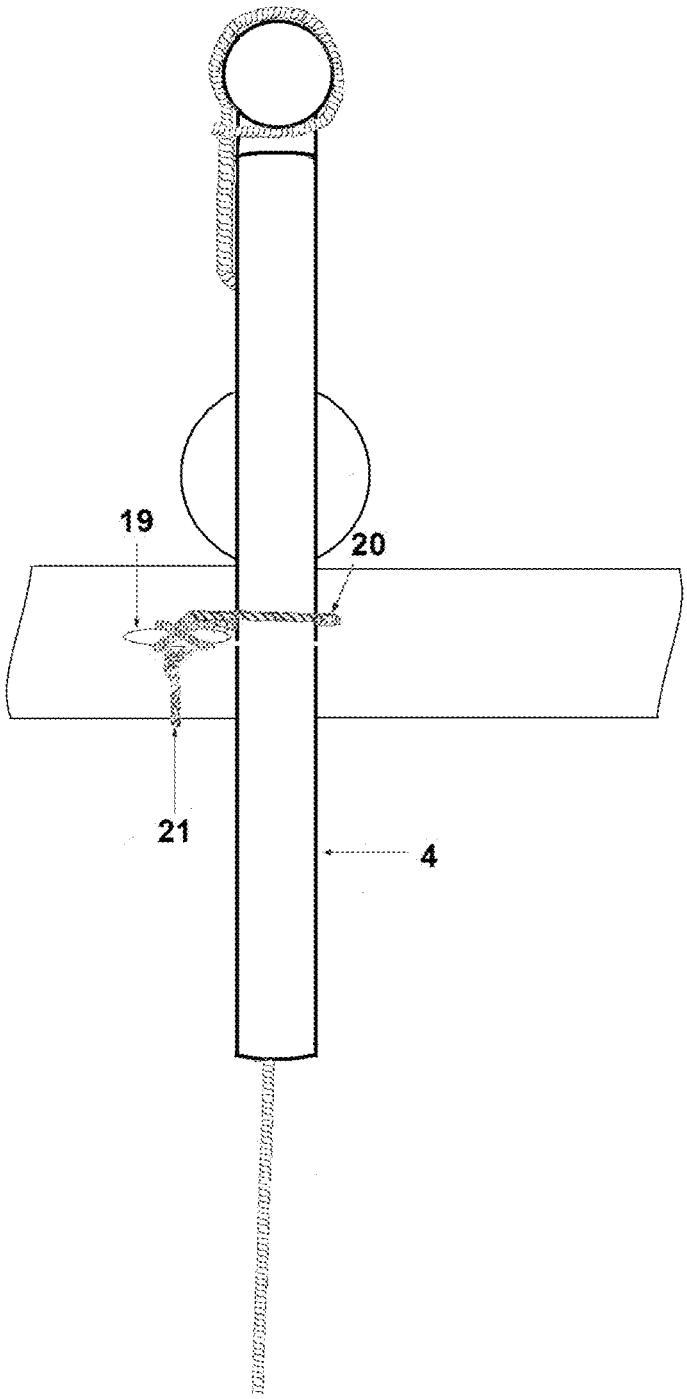
FIG. 8 is a plan view of the adjustable boat mooring standoff during installation depicting the looped first end of the second dock mooring rope placed over the straight pipe and attached to the first stern mooring cleat.

Referring to FIG. 8, the looped first end 20 of the second dock mooring rope 21 is positioned around the straight pipe 4 and secured to the first stern mooring cleat 19.

Figure 9:
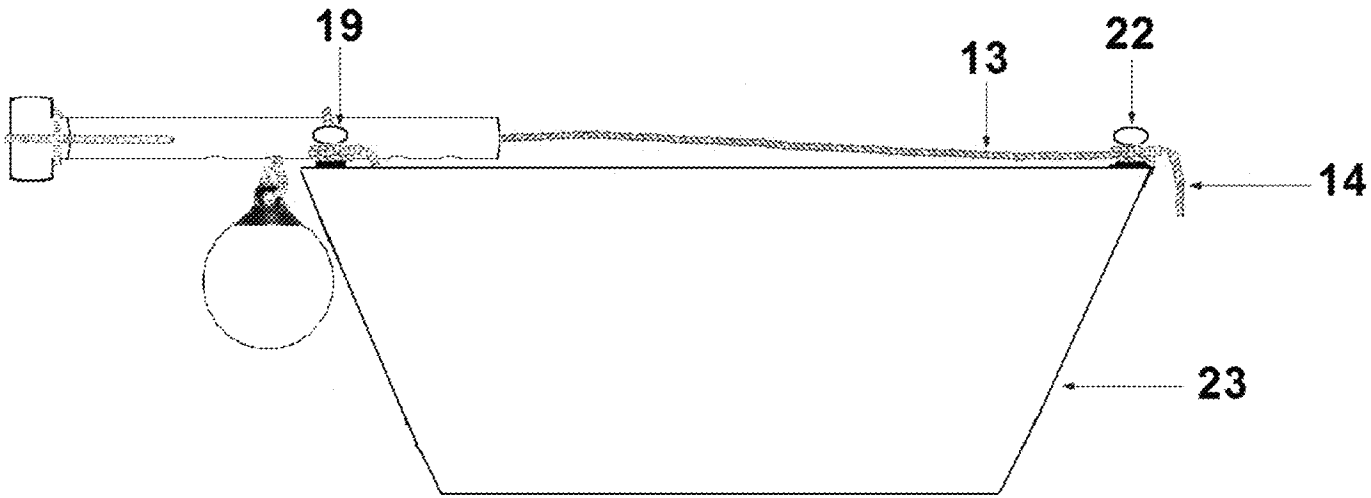
FIG. 9 is an elevation view of the adjustable boat mooring standoff during installation depicting the second end of the first dock mooring rope routed around the second stern mooring cleat located on the second side of the boat opposite the first stern mooring cleat.

Referring to FIG. 9, the second end 14 of the first dock mooring rope 13 is secured to the second stern mooring cleat 22 located on the second side 23 opposite the first stern mooring cleat 19.

Figure 10:
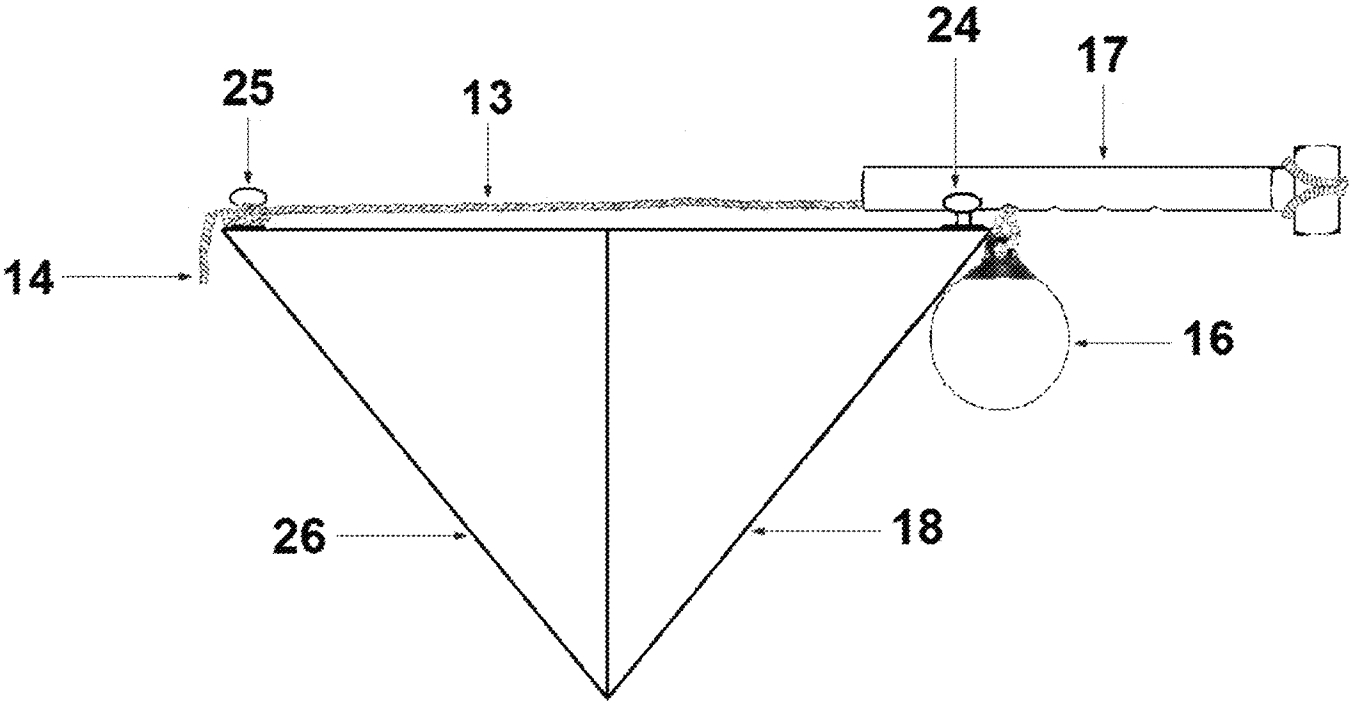
FIG. 10 is an elevation view of the adjustable boat mooring standoff during installation depicting the adjustable boat mooring standoff placed on the first side of the boat near the first bow mooring cleat with the mooring buoy positioned on the exterior of the first side of the boat and pointed down and the second end of the first dock mooring rope routed around the second bow mooring cleat located on the second side of the boat opposite the first bow mooring cleat.

Referring to FIG. 10, the adjustable boat mooring standoff 17 is positioned on the first side 18 near the first bow mooring cleat 24 with the mooring buoy 16 on the exterior of the first side 18 and pointed down. The second end 14 of the first dock mooring rope 13 is secured to the second bow mooring cleat 25 located on the second side 26 opposite the first bow mooring cleat 24.

Figure 11:
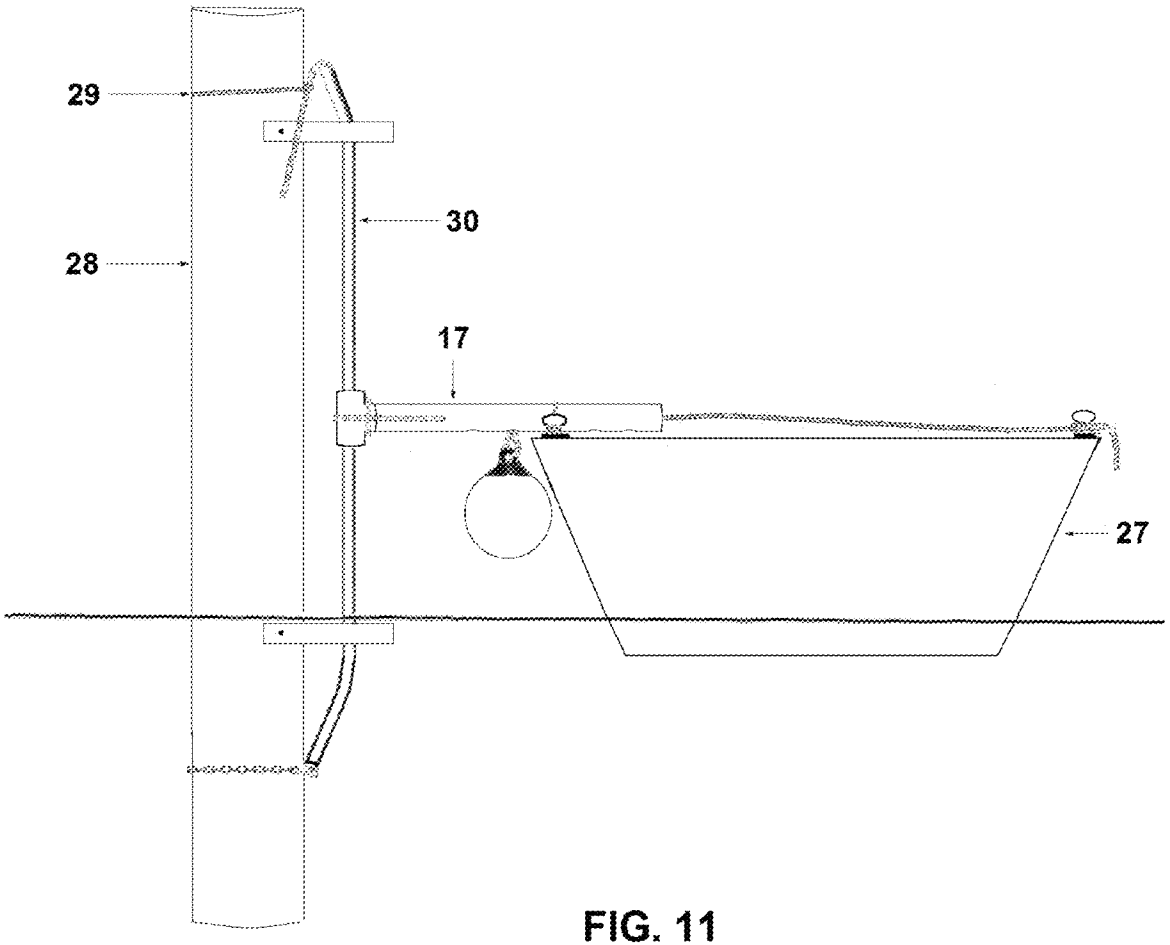
FIG. 11 is an elevation view of the adjustable boat mooring standoff during use depicting the adjustable boat mooring standoff mounted on a boat which is moored to a piling using the adjustable boat mooring standoff attached to a rope encased in a PVC pipe and attached vertically to the piling.

FIG. 11 shows the boat 27 moored to the piling 28 using the adjustable boat mooring standoff 17 which is attached to the rope 29 encased in the PVC pipe 30 and attached vertically to the piling 28.

Figure 12:
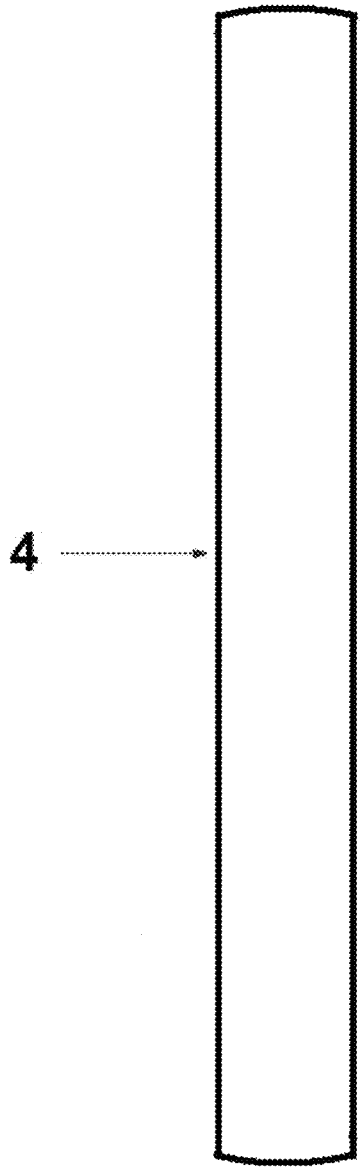
FIG. 12 is a plan view of the adjustable boat mooring standoff during assembly depicting the straight pipe.

FIG. 12 shows the first straight pipe 4.

Figure 13:
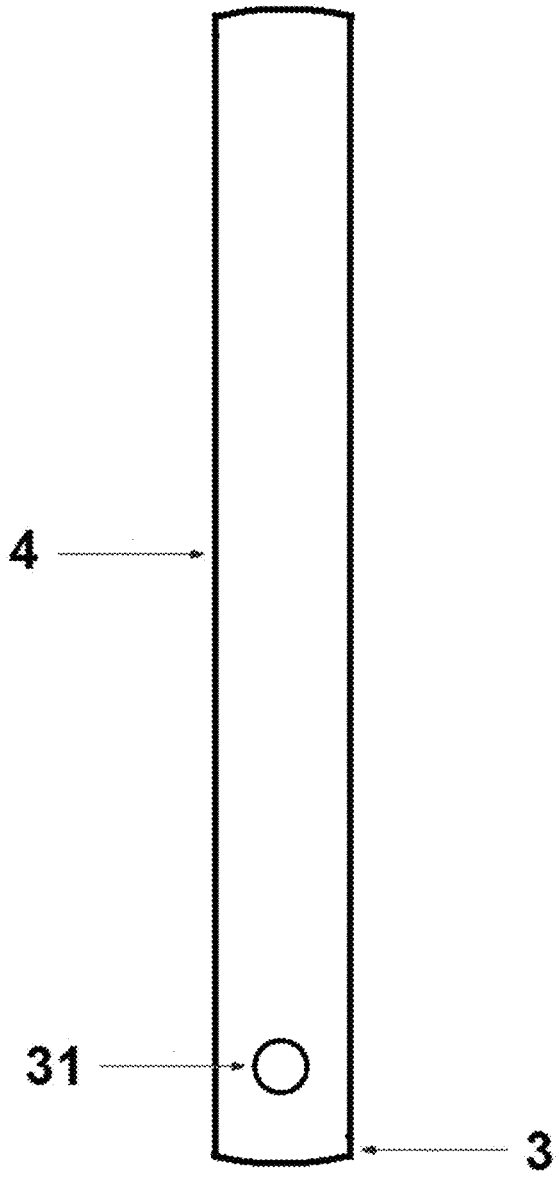
FIG. 13 is a plan view of the adjustable boat mooring standoff during assembly depicting an attachment hole drilled on the bottom center line of the straight pipe near the first end of the straight pipe.

Referring to FIG. 13, an attachment hole 31 is drilled on the bottom center line of the straight pipe 4 near the first end 3 of the straight pipe 4.

Figure 14:
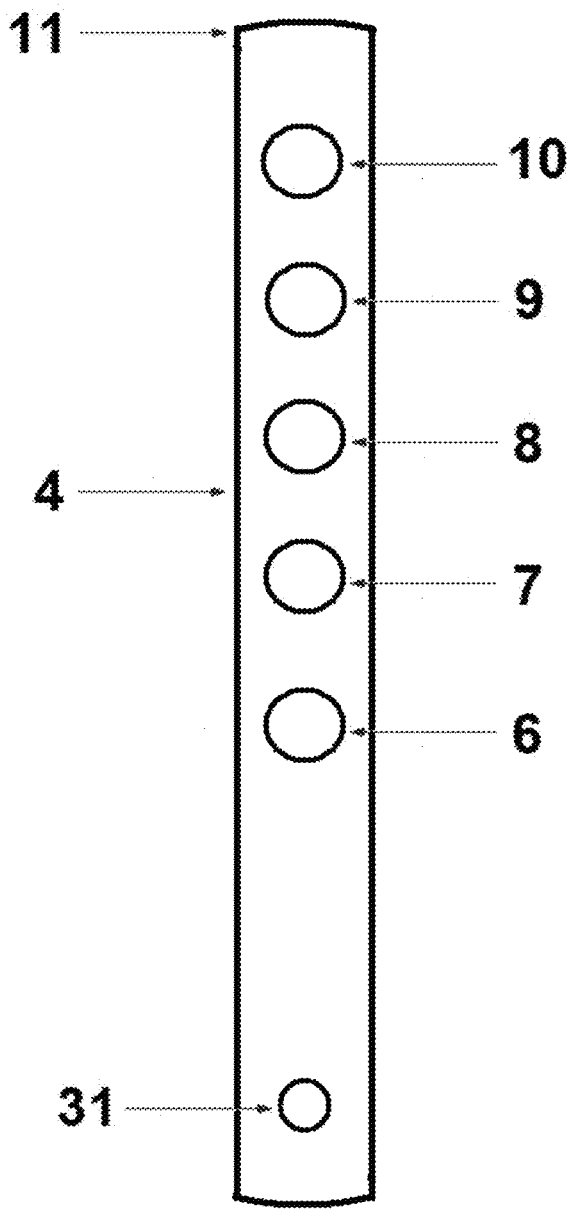
FIG. 14 is a plan view of the adjustable boat mooring standoff during assembly depicting five buoy support holes drilled on the bottom center line of the straight pipe between the attachment hole and the second end of the straight pipe.

Referring to FIG. 14, five buoy support holes, 6, 7, 8, 9, and 10, are drilled on the bottom center line of the straight pipe 4 between the attachment hole 31 and the second end 11 of the straight pipe 4.

Figure 15:
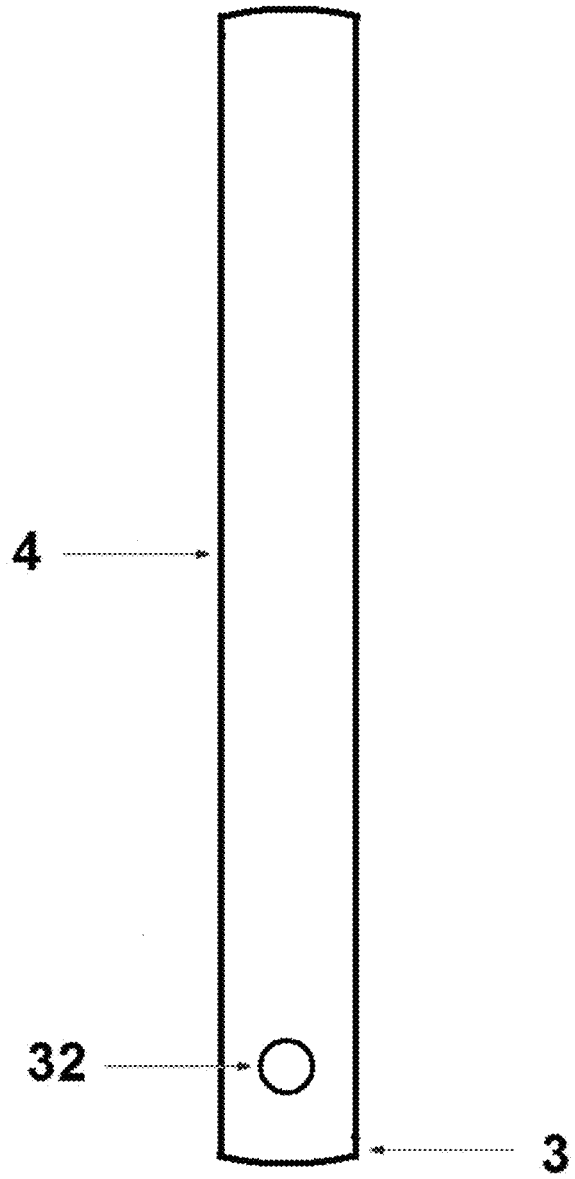
FIG. 15 is a plan view of the adjustable boat mooring standoff during assembly depicting an attachment hole drilled on the top center line of the straight pipe near the first end of the straight pipe.

Referring to FIG. 15, an attachment hole 32 is drilled on the top center line of the straight pipe 4 near the first end 3 of the straight pipe 4.

Figure 16:
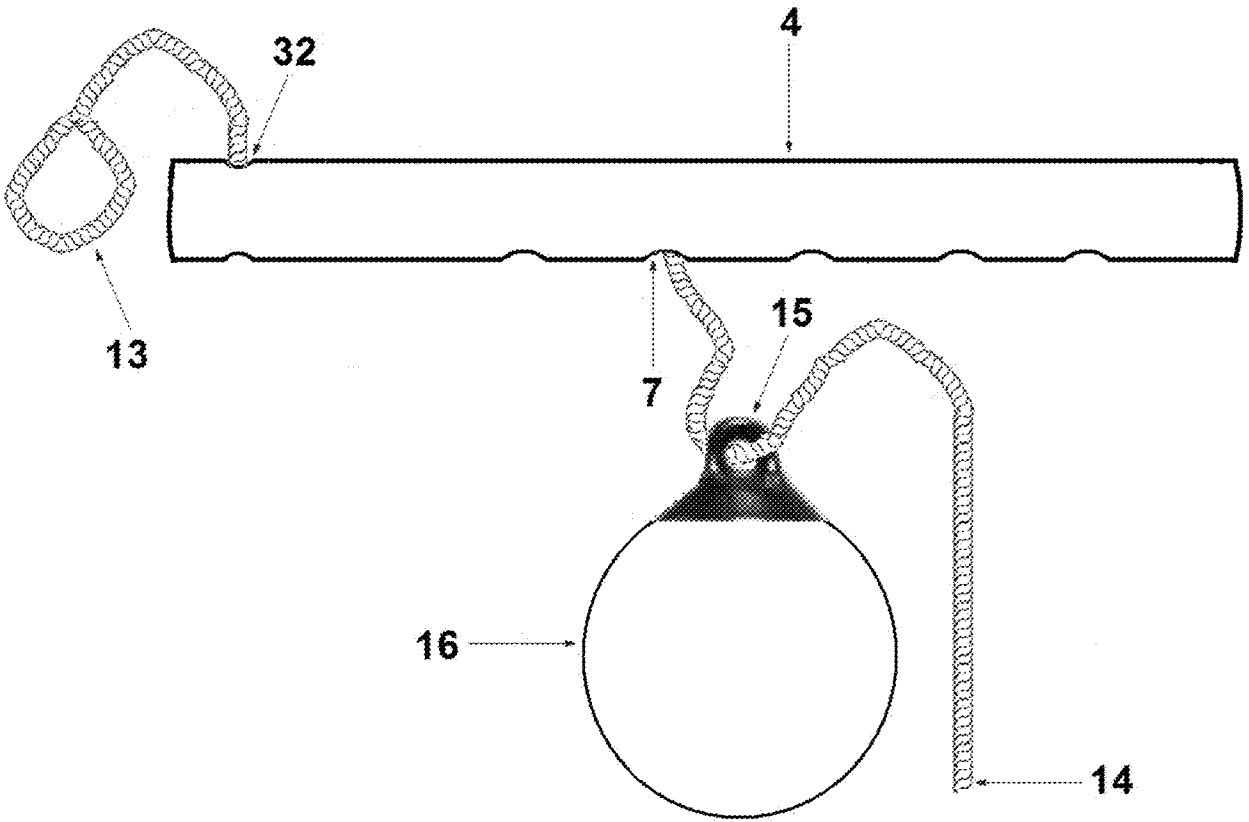
FIG. 16 is an elevation view of the adjustable boat mooring standoff during assembly depicting the second end of the first dock mooring rope routed through the attachment hole on the top center line of the straight pipe and through the interior of the straight pipe and out of the second buoy support hole on the bottom center line of the straight pipe and through the eye of the mooring buoy.

Referring to FIG. 16, the second end 14 of the first dock mooring rope 13 is routed through the attachment hole 32 on the top center line of the straight pipe 4. The second end 14 of the first dock mooring rope 13 extends through the interior of the straight pipe 4 and out of the second buoy support hole 7 on the bottom center line of the straight pipe 4 and through the eye 15 of the mooring buoy 16.

Figure 17:
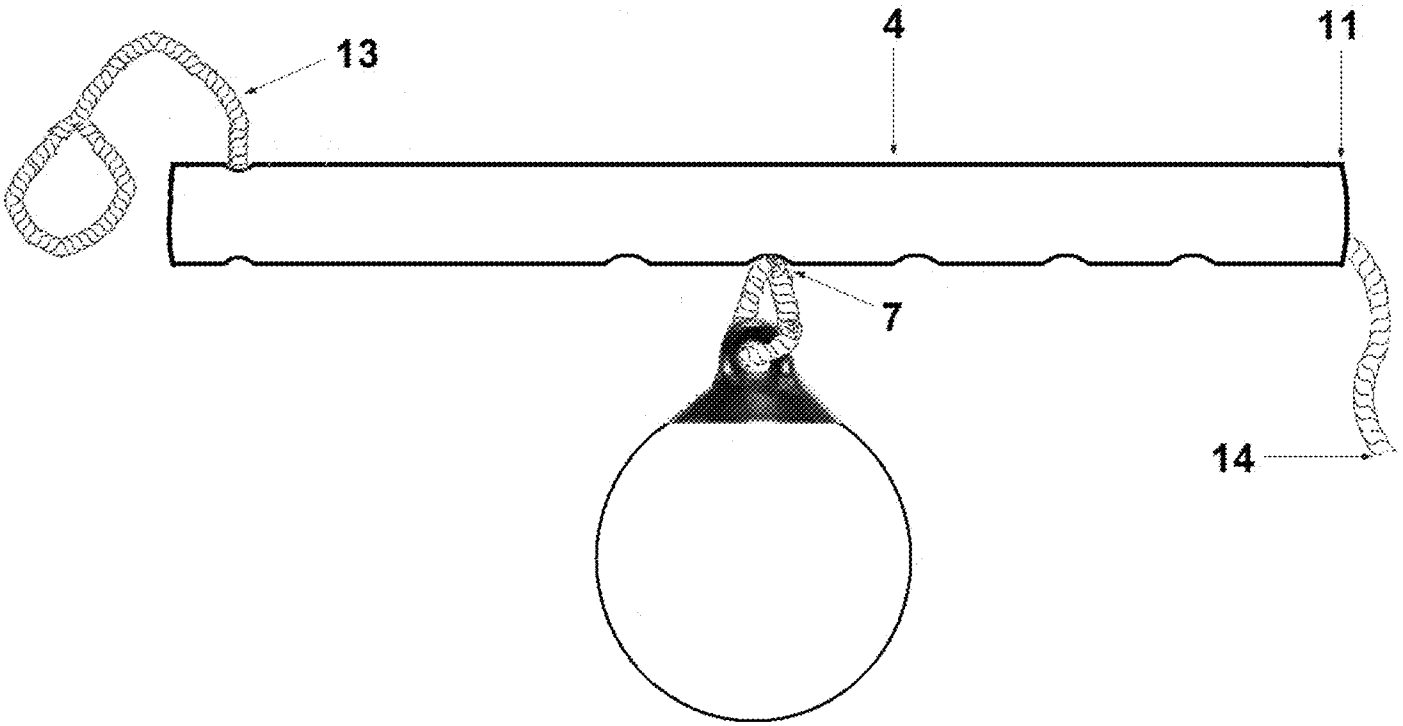
FIG. 17 is an elevation view of the adjustable boat mooring standoff during assembly depicting the second end of the first dock mooring rope routed back through the second buoy support hole on the bottom center line of the straight pipe and through the interior of the straight pipe and out of the second end of the straight pipe.

Referring to FIG. 17, the second end 14 of the first dock mooring rope 13 extends back through the second buoy support hole 7 on the bottom center line of the straight pipe 4 and through the interior of the straight pipe 4 and out of the second end 11 of the straight pipe 4.

Figure 18:
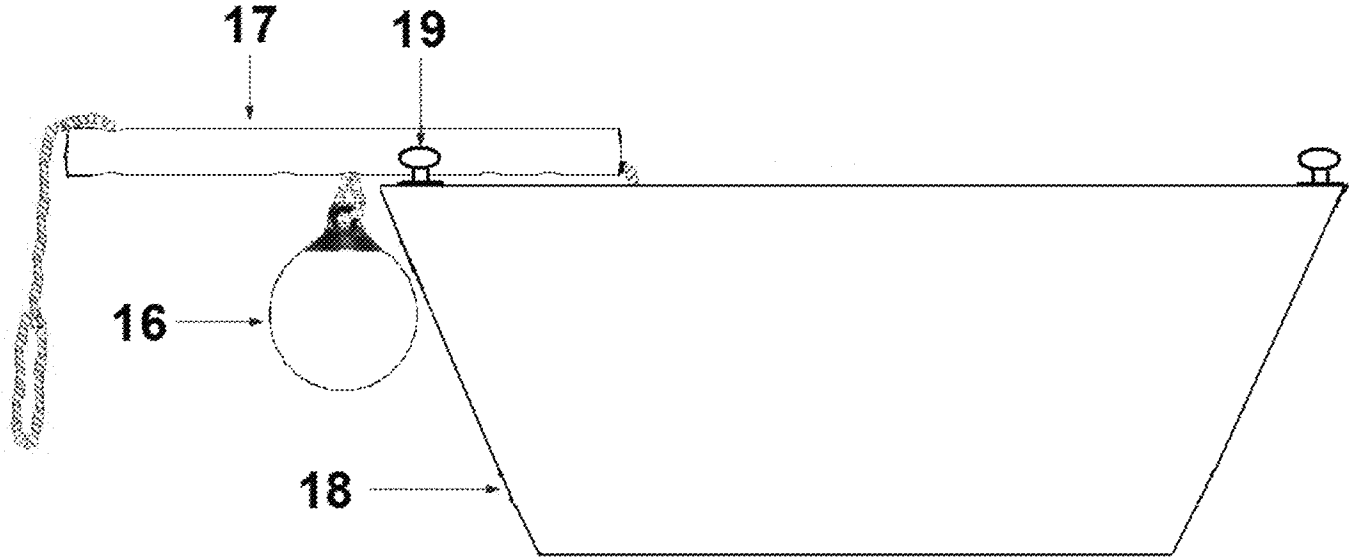
FIG. 18 is an elevation view of the adjustable boat mooring standoff during installation depicting the adjustable boat mooring standoff placed on the first side of the boat near the first stern mooring cleat with the mooring buoy positioned on the exterior of the first side of the boat and pointed down

Referring to FIG. 18, the adjustable boat mooring standoff 17 is positioned on the first side 18 near the first stern mooring cleat 19 with the mooring buoy 16 on the exterior of the first side 18 and pointed down.

Figure 19:
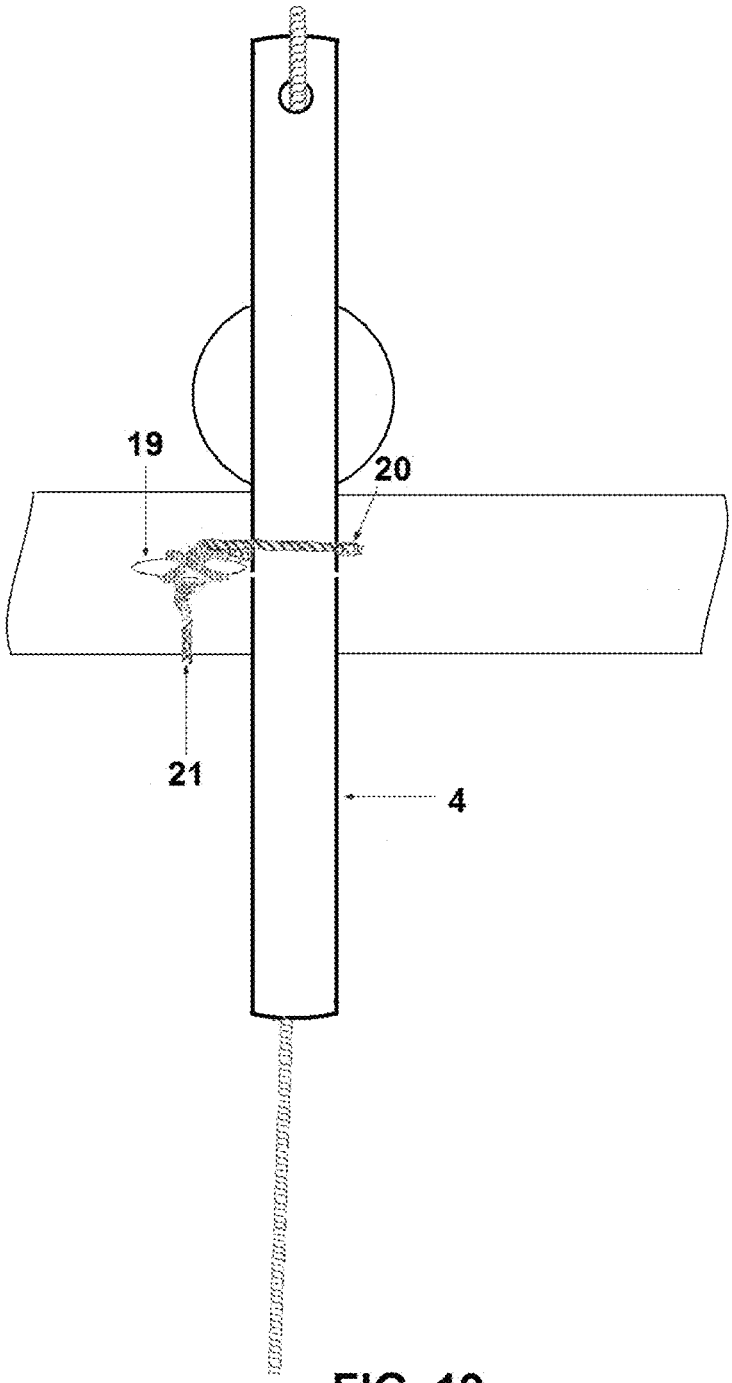
FIG. 19 is a plan view of the adjustable boat mooring standoff during installation depicting the looped first end of the second dock mooring rope placed over the straight pipe and attached to the first stern mooring cleat.

Referring to FIG. 19, the looped first end 20 of the second dock mooring rope 21 is positioned around the straight pipe 4 and secured to the first stern mooring cleat 19.

Figure 20:
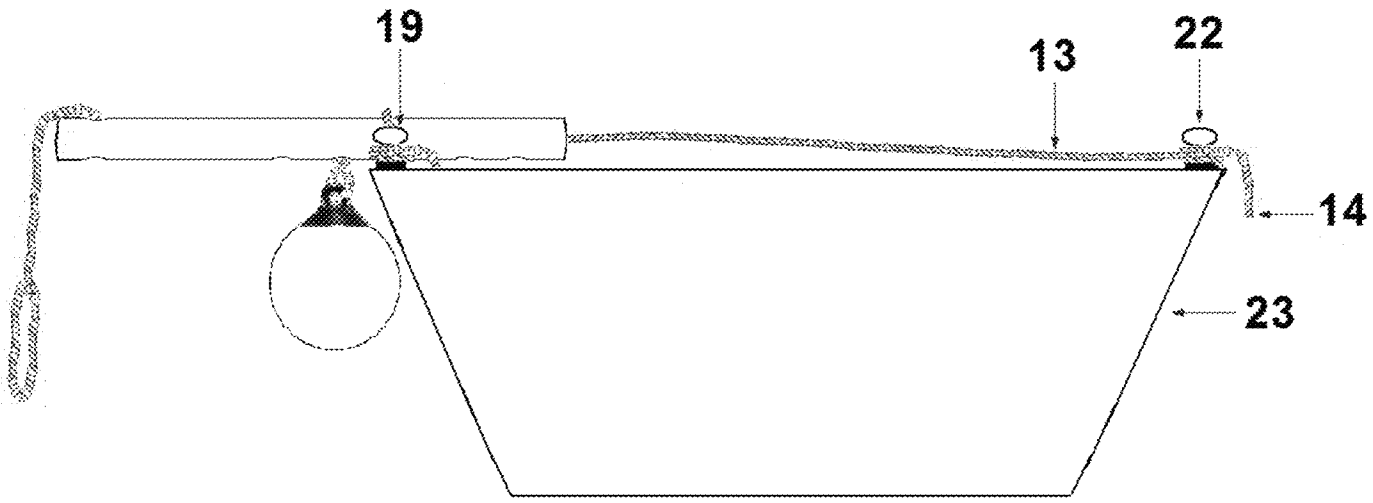
FIG. 20 is an elevation view of the adjustable boat mooring standoff during installation depicting the second end of the first dock mooring rope routed around the second stern mooring cleat located on the second side of the boat opposite the first stern mooring cleat.

Referring to FIG. 20, the second end 14 of the first dock mooring rope 13 is secured to the second stern mooring cleat 22 located on the second side 23 opposite the first stern mooring cleat 19.

Figure 21:
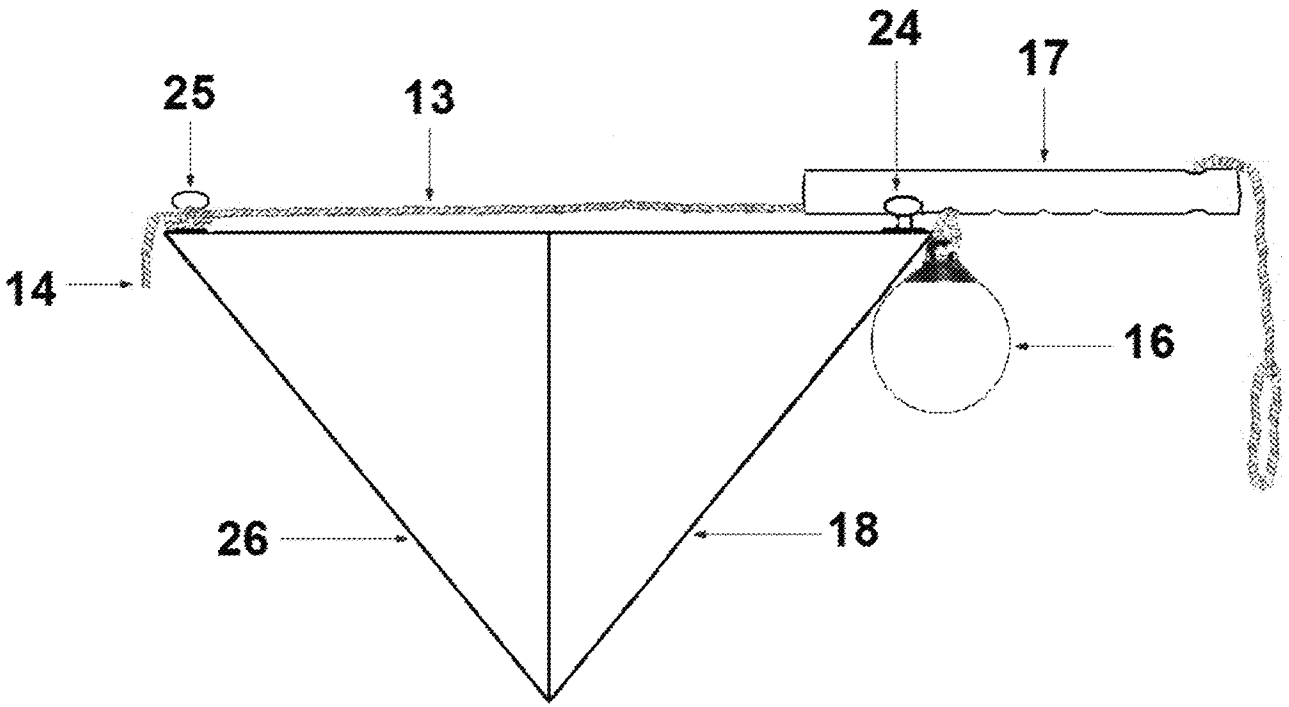
FIG. 21 is an elevation view of the adjustable boat mooring standoff during installation depicting the adjustable boat mooring standoff placed on the first side of the boat near the first bow mooring cleat with the mooring buoy positioned on the exterior of the first side of the boat and pointed down and the second end of the first dock mooring rope routed around the second bow mooring cleat located on the second side of the boat opposite the first bow mooring cleat.

Referring to FIG. 21, the adjustable boat mooring standoff 17 is positioned on the first side 18 near the first bow mooring cleat 24 with the mooring buoy 16 on the exterior of the first side 18 and pointed down. The second end 14 of the first dock mooring rope 13 is secured to the second bow mooring cleat 25 located on the second side 26 opposite the first bow mooring cleat 24.

Figure 22:
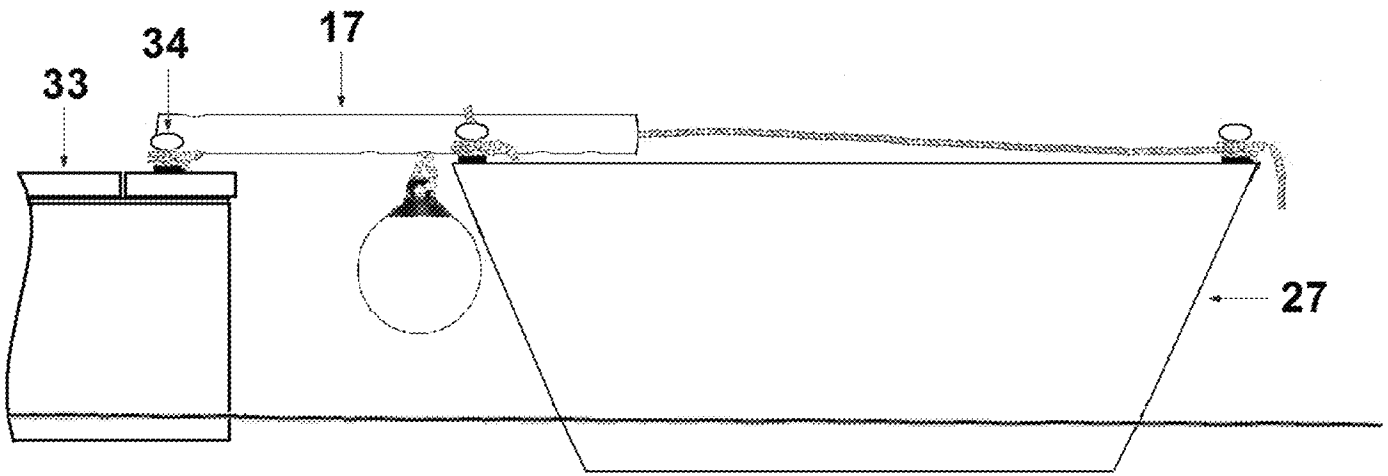
FIG. 22 is an elevation view of the adjustable boat mooring standoff during use depicting the adjustable boat mooring standoff mounted on a boat which is moored to a floating dock using the adjustable boat mooring standoff attached to a dock cleat.

FIG. 22 shows a boat 27 moored to a floating dock 33 using the adjustable boat mooring standoff 17 which is attached to a dock mooring cleat 34.

Figure 23:
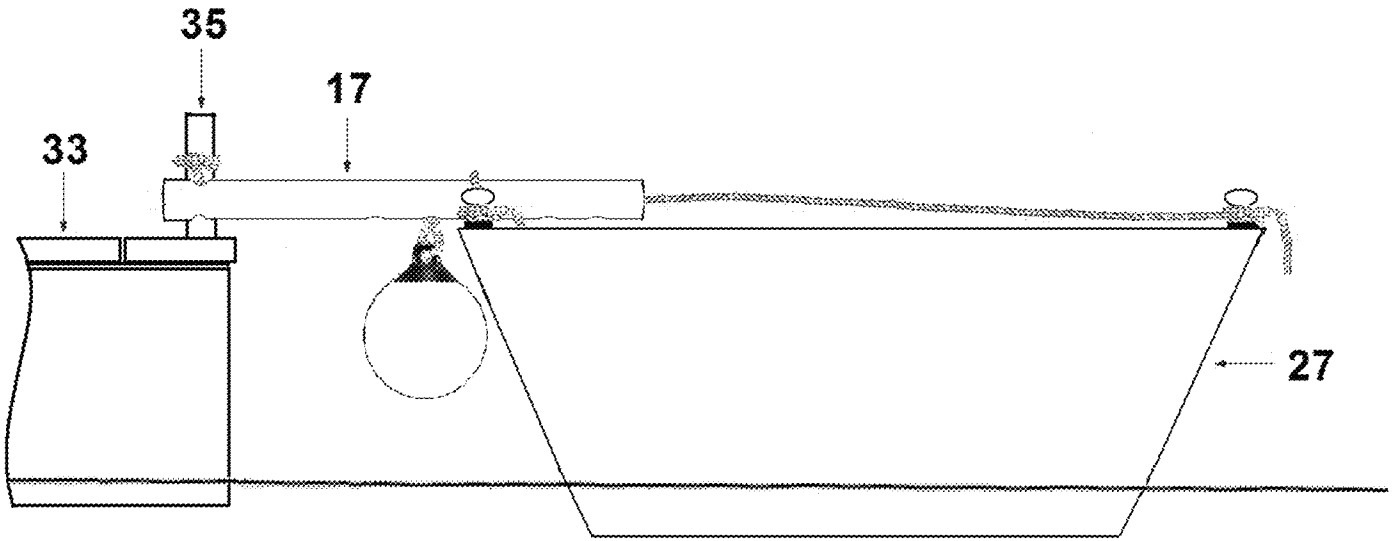
FIG. 23 is an elevation view of the adjustable boat mooring standoff during use depicting the adjustable boat mooring standoff mounted on a boat which is moored to a floating dock using the adjustable boat mooring standoff attached to a dock post.

FIG. 23 shows a boat 27 moored to a floating dock 33 using the adjustable boat mooring standoff 17 which is attached to a dock post 35.

I claim:

1. An adjustable boat mooring standoff mounted to a boat instead of a dock used to moor a boat to a dock, pier, or piling by means of:

a straight tee with the two in line outlets of the tee aligned vertically to compensate for vertical movement of the boat caused by large waves or tidal changes; and to provide flexibility to the adjustable boat mooring standoff because the tee moves freely and is not rigidly attached to the dock, pier, or piling; and to facilitate attachment of the first end of a dock mooring rope to the adjustable boat mooring standoff;

a straight pipe with the first end connected to the main branch outlet of the straight tee to provide a means to route the dock mooring rope to the boat mooring cleat located on the second side of the boat opposite the first side of the boat where the adjustable boat mooring standoff is located; and to provide a means to attach a mooring buoy, bumper, or fender between the dock, pier, or piling and the boat to hold the boat in position away from the dock, pier, or piling;

an access hole in the side of the straight pipe to provide a means to route the dock mooring rope from the straight tee through the interior channel of the straight pipe to the boat mooring cleat located on the opposite side of the boat from the adjustable boat mooring standoff;

one or more buoy support holes in the bottom of the straight pipe to provide a means to attach a mooring buoy, bumper, or fender to the straight pipe, and to provide a means to change the position of the mooring buoy, bumper, or fender on the straight pipe in order to make the boat mooring standoff adjustable;

a dock mooring rope with the first end attached to the straight tee and the second end routed through the access hole in the side of the straight pipe and through the interior channel of the straight pipe and out of one of the buoy support holes in the bottom of the straight pipe and through the eye of a mooring buoy, bumper, or fender and back through the buoy support hole in the bottom of the straight pipe and through the interior channel of the straight pipe and out of the second end of the straight pipe and attached to the boat mooring cleat located on the opposite side of the boat from the adjustable boat mooring standoff to pull the mooring buoy, bumper, or fender tightly against the exterior side of the boat.

2. The device of claim 1, wherein the straight tee is replaced with an attachment hole in the top and an attachment hole in the bottom of the straight pipe near the first end of the straight pipe; and a dock mooring rope with the first end attached to a dock, pier, or piling and the second end routed through an attachment hole in the top or bottom of the straight pipe near the first end of the straight pipe and through the interior channel of the straight pipe and out of one of the buoy support holes in the bottom of the straight pipe and through the eye of a mooring buoy, bumper, or fender and back through the buoy support hole in the bottom of the straight pipe and through the interior channel of the straight pipe and out of the second end of the straight pipe and attached to the boat mooring cleat located on the opposite side of the boat from the adjustable boat mooring standoff to pull the mooring buoy, bumper, or fender tightly against the exterior side of the boat.

* * * * *